US005536557A

United States Patent [19]

Nasvik et al.

[11] Patent Number: 5,536,557

[45] Date of Patent: Jul. 16, 1996

[54] SINGLE STONE FORM LINER

[75] Inventors: Peter A. Nasvik, West St. Paul, Minn.; Paul C. Nasvik, Hudson, Wis.

[73] Assignee: Concrete Design Specialties, Inc., St. Paul, Minn.

[21] Appl. No.: 996,012

[22] Filed: Dec. 23, 1992

Related U.S. Application Data

[63] Continuation-in-part of Ser. No. 611,179, Nov. 7, 1990, Pat. No. 5,232,646.

[51] Int. Cl.[6] ..... D06N 7/04; E04G 9/10

[52] U.S. Cl. ..... 428/141; 428/81; 428/156; 428/192; 249/16; 249/18; 249/112; 249/189

[58] Field of Search ..... 428/156, 172, 428/141, 99, 119, 57, 81; 249/9, 16, 18, 112, 189

[56] References Cited

U.S. PATENT DOCUMENTS

| | | | |
|---|---|---|---|
| Re. 29,945 | 3/1979 | Scott | 249/80 |
| 787,665 | 4/1905 | Deeds et al. | 249/16 |
| 827,712 | 8/1906 | Daniel | 249/15 |
| 859,704 | 7/1907 | Stevens | 249/15 |
| 969,248 | 9/1910 | Davis et al. | 249/15 |
| 1,479,647 | 1/1924 | Carroll | 249/15 |
| 1,491,205 | 4/1924 | Ford | 249/16 |
| 1,564,578 | 12/1925 | Kennedy | 25/1 |
| 1,636,396 | 7/1927 | Urschel | 249/16 |
| 1,712,678 | 5/1929 | Redman | 249/16 |
| 1,776,999 | 9/1930 | Jensen | 249/16 |
| 1,809,504 | 6/1931 | Carvel | 249/15 |
| 1,937,306 | 11/1933 | Barriball | 249/16 |
| 2,246,377 | 6/1941 | Mattes | 20/5 |
| 2,270,809 | 1/1942 | Kaye | 20/5 |
| 2,286,531 | 6/1942 | Fralick | 18/59 |
| 2,474,654 | 6/1949 | Carlson | 264/226 |
| 2,513,648 | 7/1950 | Iezzi | 249/80 |
| 2,517,432 | 8/1950 | Hornberger | 25/1 |

(List continued on next page.)

FOREIGN PATENT DOCUMENTS

| | | |
|---|---|---|
| 450070 | 7/1948 | Canada . |
| 1101365 | 10/1995 | France . |
| 158825 | 9/1984 | Japan . |
| 1-174768 | 7/1989 | Japan . |
| 214662 | 8/1989 | Japan . |

OTHER PUBLICATIONS

Article entitled "Concrete Form Construction", pp. 47–76, labelled Exhibit A.

Brochure entitled "Custom Rock Creations", dated May, 1988, 4 pages, labelled Exhibit B.

A Reinforced Earth brochure, entitled "Family of Construction Technologies", 8 pages, copyright 1990, labelled Exhibit C.

A Reinforced Earth brochure, entitled "An Advanced Construction Technology", 8 pages, coyright 1990, labelled Exhibit D.

A Reinforced Earth Company document, entitled "Standard and Custom Finishes Make Reinforced Earth Structures Attractive as Well as Functional", 1 page, copyright 1989, labeled Exhibit E.

Bomanite® Corporation brochure entitled "The Network For Concrete Innovation"; 4 pages, dated 1989, labelled Exhibit F.

(List continued on next page.)

*Primary Examiner*—Donald J. Loney

*Attorney, Agent, or Firm*—Merchant, Gould Smith, Edell, Welter & Schmidt

[57] ABSTRACT

Systems and methods are provided to contour hardenable construction material to resemble a natural stone wall. Form liners are provided which each create at least a single stone portion on the resulting wall. A plurality of form liners are matable with each other and are further securable to a form to create a first mold member for forming the wall. The form liners include a first surface portion for contouring the hardenable construction material to resemble a stone. The form liners further include a second surface portion surrounding the first surface portion for creating mortar regions on the resulting wall.

3 Claims, 7 Drawing Sheets

U.S. PATENT DOCUMENTS

| | | | |
|---|---|---|---|
| 2,616,145 | 11/1952 | Dufford | 249/15 |
| 2,629,135 | 2/1953 | Johnson | 264/426 |
| 2,689,381 | 9/1954 | Terriere | 264/157 |
| 3,002,322 | 1/1961 | Dorsett | 52/261 |
| 3,177,279 | 4/1965 | Bilodeau | 264/295 |
| 3,307,822 | 3/1967 | Stout | 249/189 |
| 3,344,570 | 10/1967 | Marson | 52/315 |
| 3,566,572 | 3/1971 | Wilkinson | 52/745 |
| 3,584,826 | 6/1971 | Liester | 249/44 |
| 3,621,625 | 11/1971 | Medow | 52/314 |
| 3,678,887 | 7/1972 | Smith | 118/504 |
| 3,844,527 | 10/1974 | Scott | 249/189 |
| 3,874,140 | 4/1975 | Seehusen | 52/315 |
| 3,950,477 | 4/1976 | Di Giacomo | 264/226 |
| 3,954,377 | 5/1976 | Scholz et al. | 425/432 |
| 4,116,415 | 9/1978 | Ward | 249/35 |
| 4,131,406 | 12/1978 | Fresquez | 425/385 |
| 4,135,840 | 1/1979 | Puccini et al. | 249/111 |
| 4,150,808 | 4/1979 | Sawyer | 249/40 |
| 4,159,097 | 6/1979 | Strickland | 249/40 |
| 4,180,232 | 12/1979 | Hardigg | 249/60 |
| 4,239,176 | 12/1980 | Salazar | 249/97 |
| 4,407,480 | 10/1983 | Trimmer et al. | 249/189 |
| 4,555,088 | 11/1985 | Chang | 249/192 |
| 4,590,726 | 5/1986 | Salazar | 52/314 |
| 4,656,722 | 4/1987 | Armstrong | 29/527.2 |
| 4,668,457 | 5/1987 | Nakai et al. | 428/15 |
| 4,680,914 | 7/1987 | Migliore | 52/747 |
| 4,704,316 | 11/1987 | Grace | 428/15 |
| 4,731,209 | 3/1988 | Nakai et al. | 428/15 |
| 4,750,703 | 6/1988 | Gentilcore et al. | 249/6 |
| 4,887,789 | 12/1989 | Harris et al. | 249/16 |

OTHER PUBLICATIONS

Bomanite® Corporation brochure entitled, "Bomacron® Patterns", Bomanite Patterns, and Bomanite Guideline Specification, 4 pages, dated 1989, labelled Exhibit G.

Custom Rock International document, Project Profile, Custom Rock Form Liners, Random Large Stone, Leif Ericson Tunnel, Duluth, Minnesota, completed 1991, 2 pages, labelled Exhibit H.

Custom Rock International document, Project Profile, Custom Rock Form Liners, Adjustable Random Field Stone, Nine Mile Creek Watershed Park, Bloomington, Minnesota, completed 1991, 2 pages, labelled Exhibit I.

Fitzgerald Construction Sales, Inc., catalog, entitled, *Fitzgerald Formliners*, 8 pages, copyright 1986, labelled Exhibit J.

Fitzgerald Construction Sales, Inc., lieterature, entitled "Architectural Concrete Design—at lower cost", Schal--plast, Fiberglass Reinforced Flexible Formliners, and Fiberlyte, 4 pages, copyright 1985, labelled Exhibit K.

L. M. Scofield Company Project Information Sheet, 2 pages, dated Mar. 1992, labelled Exhibit L.

SINGLE STONE FORM LINER

RELATED APPLICATIONS

The present application is a continuation-in-part application of application Ser. No. 07/611,179, filed Nov. 7, 1990 now U.S. Pat. No. 5,232,646.

FIELD OF THE INVENTION

The present invention relates generally to walls made from hardenable construction materials, such as concrete, having at least one contoured face. In particular, the present invention relates to concrete walls contoured to have the appearance of a stone wall.

BACKGROUND OF THE INVENTION

In the past, walls have been constructed from individual units such as stones, rocks, blocks, or bricks which are assembled into the shape of a wall and held together with a bonding substance, such as mortar.

One problem with a wall of this type is that they are typically expensive and time consuming to construct. One alternative type of wall involves constructing a wall from a hardenable construction material, such as poured concrete. Concrete walls of this type may be constructed so that the face of the wall is substantially smooth. A concrete wall may also be textured, thereby having the appearance of a wall formed from a plurality of individual assembled units, such as bricks. U.S. Pat. No. 3,307,822 (the '822 patent) illustrates one example of constructing a vertical wall from concrete creating the appearance of a wall formed from individual bricks. The '822 patent also illustrates a technique of providing a vertical concrete wall with a contoured surface by pouring the concrete wall between mold members that leave behind a contour on one or more of the lateral faces of the wall once the concrete hardens.

Additional techniques are known in the construction industry for creating concrete surfaces with textures and patterns. In the past, horizontal concrete surfaces, such as roads, sidewalks, and floors, have been provided with textured surfaces, for example, by stamping a contour into the concrete before it hardens. Vertical concrete walls have also been provided with textured surfaces by adding a desired texture to a surface through veneering, wherein another material is adhered to the exterior surface of the concrete wall.

One problem that arises when pouring a hardenable construction material between mold members to create a vertical concrete wall having the contour of a wall formed from individual units is the problem of part lines or seam lines being formed through the portions of the wall that resemble the individual units. For example, individual bricks, or other units, will have a seam through the middle of the brick, thus making it apparent that the bricks are not real bricks. Seam lines result at the intersection of two mold members, used to form a portion of a continuous concrete wall. Seam lines detract from the appearance of the wall, and reduce the natural looking qualities of the concrete wall. Seam lines may be removed through sanding, but this requires an extra step during the construction process, and may result in the sanded portions having a different texture than the surrounding concrete.

A further problem arises in trying to simulate natural rock of randomly sized and/or shaped units, intended to resemble a natural stone wall. When it is desired to have a natural looking concrete wall that appears to be formed from a plurality of non-linear and/or non-uniform units, the concrete wall may not appear natural if a repeating pattern is easily visible. Such a problem does not exist in forming a brick wall where all bricks have the same dimensions. The ability to easily and inexpensively create the appearance of a nonrepeating pattern in a stone wall has been a significant concern in the construction industry.

It is clear that a long and unfilled need has existed in the art for a system for more easily and inexpensively forming walls with one or more contoured faces, that resemble individual assembled building units. In addition, there is a need for a system for use in more easily creating a concrete wall with one or more faces that more naturally resembles a wall formed from individual non-linear and/or non-uniform building units, such as stones. The present invention solves these and other problems associated with the prior art.

SUMMARY OF THE INVENTION

The present invention relates to a method of forming a wall having the contour and appearance of a natural stone wall. A first pair of mold members, which each include a lateral mold face, are provided. At least one of the lateral mold faces is a lateral relief mold face that comprises a plurality of interlocking contoured relief portions, adapted to provide a molded surface having the contour of a stone wall. The mold members are secured such that the lateral mold faces face one another, preferably substantially parallel to one another, at a distance equal to the desired thickness of the wall. A molding cavity between the mold members is defined by securing the edges between the mold faces, as necessary. The cavity is filled with a hardenable construction material, such as concrete, and the hardenable construction material is allowed to set. The mold members are removed from the set construction material leaving a wall portion that has at least one lateral face having the contour and appearance of a stone wall formed from the lateral relief mold face. The wall portion further has first and second non-linear mating surfaces on opposite sides of the lateral face. The method of forming the wall further includes repeating the process described above with a second pair of mold members placed in interlocking relationship with the previously formed non-linear mating surfaces of the wall portion.

A second method of forming a wall having the contour of a stone wall includes combining more than one mold module together to form a larger mold member, or gang form mold member, prior to using the mold member to mold a section of a wall. A plurality of mold modules are provided, each having lateral mold faces, comprising a plurality of interlocking contoured relief portions that are adapted to provide a molded surface having the contour of a stone wall. The mold modules are first assembled to form the gang form mold member or first mold member. A second mold member, that includes either a planar face, or a contoured face like the first mold member, is used to define the mold cavity. The second method employs substantially the same steps as the first method described for pouring the wall between the first and second mold members. The resulting wall has integrally and simultaneously formed wall portions instead of successively formed wall portions as described above for the first method.

The present invention also includes a third method of forming a wall having the contour of a stone wall wherein a plurality of individual wall portions are separately pre-cast between mold members in accordance with some of the steps of the first method such that each pre-cast wall portion is movable to a desired location for assembly into a wall. The third method includes the step of assembling the wall portions by interlocking the non-linear surfaces of each wall portion to form a continuous wall.

The present invention also relates to a contoured wall wherein the wall includes a plurality of interlocking wall portions. The wall portions each include a pair of non-linear mating surfaces. First and second lateral faces are provided on each wall portion and at least one of the lateral faces has a plurality of contoured relief portions interlocking so as to give the appearance of a stone wall. Each of the non-linear mating surfaces interlocks with a reciprocal non-linear mating surface on an adjacent wall portion. The non-linear mating surfaces comprise a plurality of surface portions, pairs of which meet to form grooves that are adapted to mate securely with a reciprocal pair of surface portions on an adjacent wall portion. The wall portions also include a top surface and a bottom surface that may be linear or non-linear.

The adjacent wall portions are preferably integrally and simultaneously formed. In an alternative embodiment, a plurality of wall portions are successively formed with a first wall portion formed in position and each successive wall portion formed successively in position in interlocking relationship with the previously formed wall portion. In a further alternative embodiment, each wall portion may be pre-cast separately and assembled to form the wall.

The present invention also relates to a form liner for use in forming a wall having a stone wall contour wherein the form liner includes a lateral relief mold face having a plurality of contoured relief portions interlocking so as to provide a molded surface with the appearance of a stone wall. The form liner also includes a top edge and a bottom edge. A pair of non-linear mating edges is provided on the form liner, extending from the top edge to the bottom edge. The top and bottom edge may also include non-linear mating edges. The mating edges are adapted to be interlocked with a reciprocal non-linear mating edge of an adjacent second form liner also having a lateral relief mold face with the plurality of interlocking contoured relief portions.

The present invention also relates to systems and methods of forming a wall having an exterior surface with a natural stone wall contour including a plurality of stone regions, wherein the stone regions are formed by individual form liners each capable of forming a single stone region. The single stone form liners are securable to a form, or backing member, to create a first mold member, or gang form, having a continuous lateral relief mold face. The gang form can include a plurality of liners in the horizontal direction and in the vertical direction. When a molding cavity is created adjacent the continuous lateral relief mold face and is subsequently filled with a hardenable construction material, the continuous lateral relief mold face contours the hardenable construction material to form the exterior surface of the wall including a plurality of stone regions, thereby creating a wall having a natural stone wall contour. In some cases, the form liners can be provided with structures for creating multiple stone regions with respect to each form liner.

Each single stone form liner may be provided with an outer periphery adapted to contour at least a portion of a mortar region surrounding the stone region created by the form liner. Dry stack patterns may be created where the outer periphery of each liner defines the edges of each stone region in a dry stack wall where the stone regions resemble a stack of stones where no mortar region is visible.

The single stone form liners may have a variety of shapes, including rectangular. Different sizes and/or different shapes may be provided to the plurality of single stone form liners secured to the form to create the gang form. If different form liners are provided with different lengths and/or widths, one preferred embodiment includes liners with dimensions that are commonly divisible. This permits variations in positioning of the single stone form liners on the form to pour different sections of a continuous wall with different patterns, while achieving a consistent size to the gang form. This helps to create a more random looking stone wall even though the form liners are reused.

In some instances, nonrectangular perimeters to the single stone form liners may be provided. In some instances, a 45 degree angle, or other angle, may be provided relative to the vertical with respect to edge portions of the single stone form liners. Non-linear mating surfaces between adjacent form liners may be provided instead. Radiussed or other curved edges may be provided. Whether the single stone liners mate along linear edges or non-linear edges, reciprocal mating edges are needed by the first and second form liners in order to maintain a continuous lateral relief mold face. The single stone form liners may be used with the multiple stone form liners having non-linear mating edges.

BRIEF DESCRIPTION OF THE DRAWINGS

In the drawings, wherein like reference numerals generally indicate corresponding parts throughout the several views.

DETAILED DESCRIPTION OF THE PREFERRED EMBODIMENTS

Figure 1:
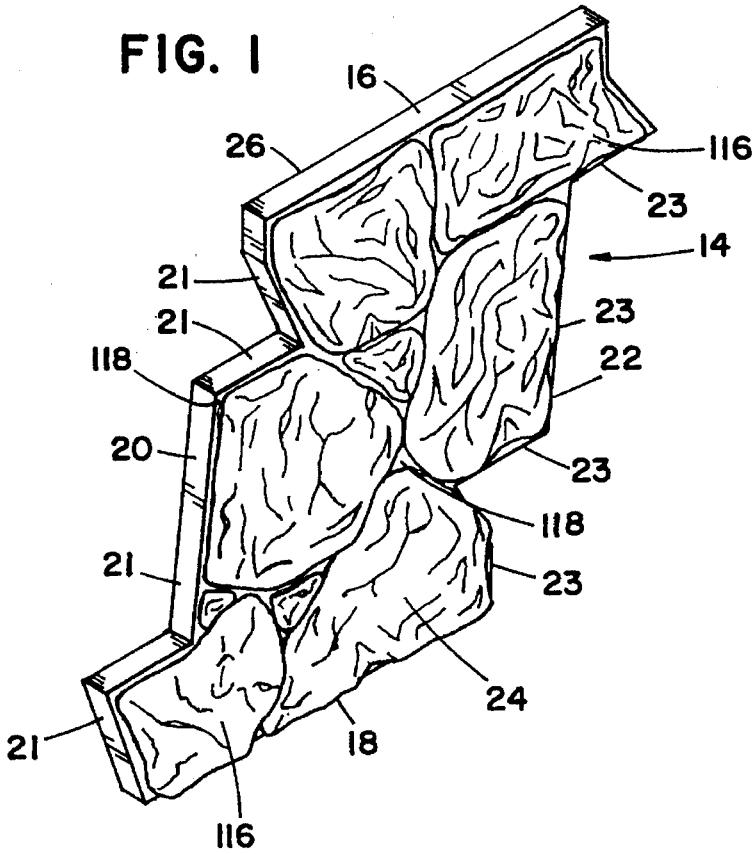
FIG. 1 is a perspective view of a wall portion having the appearance of a stone wall.

Referring now to FIG. 1, an integrally formed wall portion 14 is shown according to the principles of the present invention. The wall portion 14 is formed with a lateral face 24 having the contour of a wall formed from individual stones. A second lateral face 26 opposite lateral face 24 may also be provided with a contoured surface. The lateral face 24 has a contour that resembles a stone wall with stone-like units 116 and mortar-like portions 118. In the embodiment shown, the stone-like portions 116 are not rectangular or uniform to create the appearance of a natural looking wall formed from individual natural stones.

The wall portion 14 is preferably formed from a hardenable construction material that sets to form a rigid structure. Preferably, the hardenable construction material includes cement. In the preferred embodiment, the construction material is concrete containing cement, sand and gravel.

A first mating surface 20 and a second mating surface 22 of wall portion 14 extend along sides of the lateral face 24. First mating surface 20 and second mating surface 22 are located along mortar-like portions 118 of wall portion 14. The wall portion 14 is shaped so that the first mating surface 20 and the second mating surface 22 are adapted to be interlocked with an adjacent wall portion or portions having reciprocal mating surfaces to mating surfaces 20, 22. In this manner, a continuous wall can be formed from a plurality of wall portions 14. The resulting wall more naturally resembles a stone wall since the mating surfaces 20, 22 interlock and mate in regions of the wall that do not form the stone-like portions 116. Instead, the mating regions are located in the mortar-like portions 118 of the wall portion 14. The mating surfaces 20 and 22 include a plurality of substantially planar mating segments 21 and 23.

In the preferred embodiment, the first mating surface 20 of each wall portion 14 is the reciprocal image of its second mating surface 22. A plurality of identical wall portions 14 may be provided to interlock with one another to form the wall. Further, in the preferred embodiment, the first mating surface 20 may be mated with the first mating surface 20 of a second wall portion 14 that has been rotated, or inverted in the embodiment shown in FIG. 1, about an axis generally perpendicular to the lateral face 24. If a plurality of wall portions are provided, some with different patterns to the lateral faces, the wall portions may be arranged and interlocked to form a continuous wall where any repeating patterns in the placement of the wall portions used to form the wall are not easily visible.

In the preferred embodiment, the wall portion 14 shown in FIG. 1 has a top surface 16 and a bottom surface 18 which are generally parallel to one another. Typically, the bottom surface 18 engages the ground and supports the wall portion 14 when in the vertical orientation shown. The top surface 16 forms the top of the wall. In the alternative, the top surface 16 may provide a base for supporting a second wall portion (not shown) or a ledge member (not shown). It should be appreciated that wall portion 14 may be inverted such that top surface 16 engages the ground and the bottom surface 18 forms the top of the wall. It should further be appreciated that other embodiments are contemplated wherein the wall portions have a different number of linear sides than are shown in the Figures. In some applications, it may be possible to structure each wall portion to have a perimeter defined completely by non-linear edges or surfaces. In that case, each wall portion may be interlocked with more than two adjacent wall portions, for example, three or four.

Figure 2:
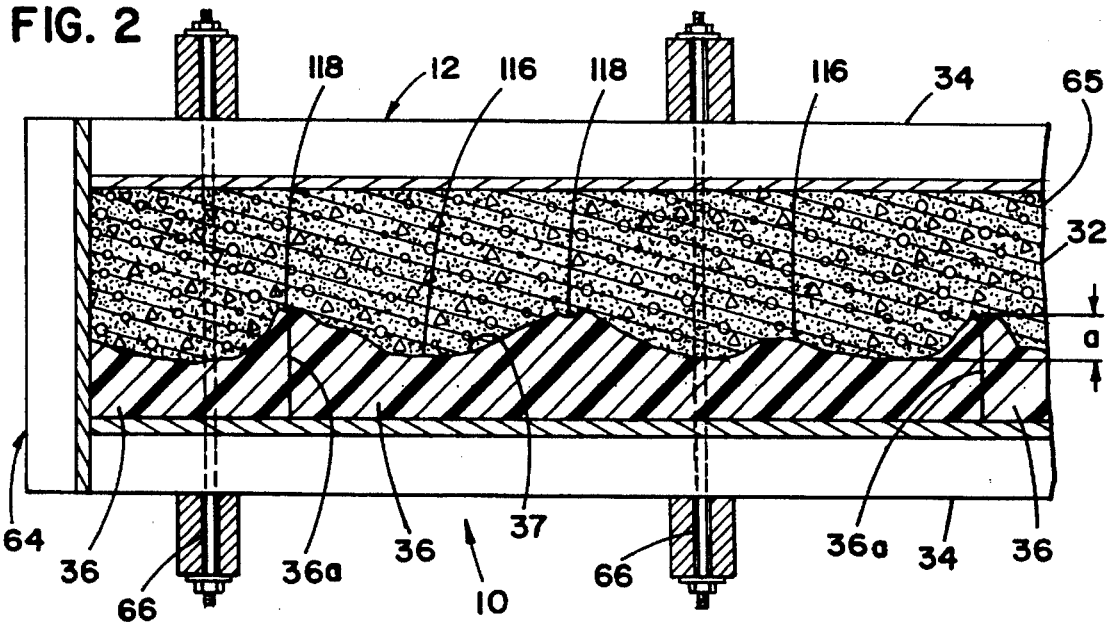
FIG. 2 is a top view in cross-section of two mold members forming a wall between the mold members.

Referring now to FIG. 2, a method is illustrated for forming a wall having the contour of a stone wall. FIG. 2 illustrates a technique of integrally and simultaneously forming a plurality of wall portions 14 from a hardenable construction material, such as concrete, poured between a first mold member 10 and a second mold member 12. In FIG. 2, the first mold member 10 consists of a form 34 with a plurality of form liners, or mold modules 36, secured to the form 34. The form liners 36 are each provided with a lateral relief mold face 37 which has a negative relief contour representing the reciprocal image of the pattern and texture of the desired molded wall.

Form 34 may be made of a variety of materials including planar members, for example, plywood, and elongate members, for example, wood boards and metal bars (not shown). The form liners 36 are attached to the form 34 in interlocking or mating relationship with adjacent form liners 36. As will be discussed below in greater detail, joints **36*a* between the form liners 36 may produce seam lines in the molded wall. However, any seam lines are located in mortar-like portions 118 of the wall and, therefore, are not easily visible. The relief mold face varies in profile by a distance designated "a" in FIG. 2**. The present invention provides a method by which the profile can vary sufficiently to provide the contour of a natural stone wall.

To form a wall according to the method shown in FIG. 2, mold member 10 and second mold member 12 are first positioned generally parallel to each other at a distance equal to the desired thickness of the wall. If the wall is designed so as to not have a uniform thickness, the mold members could be positioned at the appropriate relative angles to achieve this design. The first mold member 10 and the second mold member 12 are secured. End forms 64 are added to both of the ends of the mold members 10, 12 to form a molding cavity 65 for receiving poured hardenable construction material, such as concrete. In FIG. 2, only one end form 64 is shown, however, the opposite end form could be substantially similar to the one shown.

Ties 66 are employed to maintain the appropriate distance between the first and second mold members 10, 12. Ties 66 could be any of a variety of known structures which function to properly position and affix the mold members. The ties may be a threaded rod with nuts (shown in FIG. 2) or "snap-ties" that hold the mold members together until the construction material is hardened and then are snapped off below the outer surface of the wall to remove the mold members.

After the cavity 65 is created between the first and second mold members 10, 12 and the end forms 64, concrete 32, or some other suitable hardenable construction material, is poured into the cavity 65. The concrete 32 fills the cavity 65 and has an outer surface formed by the mold members 10, 12, and end forms 64. The concrete is permitted to set, or harden, and the mold members 10, 12 and end forms 64, are removed. The hardened concrete 32 forms a concrete wall with one face having the contour of a stone wall formed from the lateral relief mold faces 37 of the form liners 36. In the preferred embodiment, the form liners 36 and form 34 are intended to be reusable.

Once the first mold member 10 and second mold member 12 are removed from the hardened concrete, surface colors, pigments, or stains, such as chemical stains, pigmented sealers, and latex or acrylic paints, may be added to the surface of the concrete to further create the appearance a natural stone wall 32. It is to be appreciated that the concrete used to form the walls may be integrally colored with various pigments or coloring agents. Some grinding and/or filling of surface defects that are common to poured-in-place concrete walls may be necessary. It is anticipated that the concrete chosen to form the wall could be any of a wide variety of known concretes containing cement and aggregates such as sand and gravel. In particular, Type I and Type III concrete, which are commonly used in the construction industry, may be used in the present case. Other hardenable construction materials may also be utilized in the method of the present invention.

As shown in FIG. 2, the form liners 36 are attached to the form 34 to form the first mold member 10. Form liner 36 could also be formed integrally with form 34. The form liners 36 may also be provided as part of second mold member 12 to provide a concrete wall with both lateral faces molded to have the contour of a stone wall.

FIG. 2 generally represents one method of forming the concrete wall formed from a plurality of wall portions 14. It is to be appreciated that some of the techniques illustrated in FIG. 2 are also applicable to forming a wall made from single wall portions 14 formed successively in abutting relationship instead of simultaneously. In that case, a first wall portion is formed from first and second mold members 10, 12. A second mating wall portion 14 is formed after the first wall portion is hardened and the first mold member 10 and second mold member 12 are removed. In this manner, a continuous wall may be formed from two mold members that form a single wall portion 14 at a time. Alternatively, a plurality of wall portions 14 may formed independently of each other and assembled on-site into a continuous wall as a type of prefabricated or pre-cast construction technique.

Figure 5:
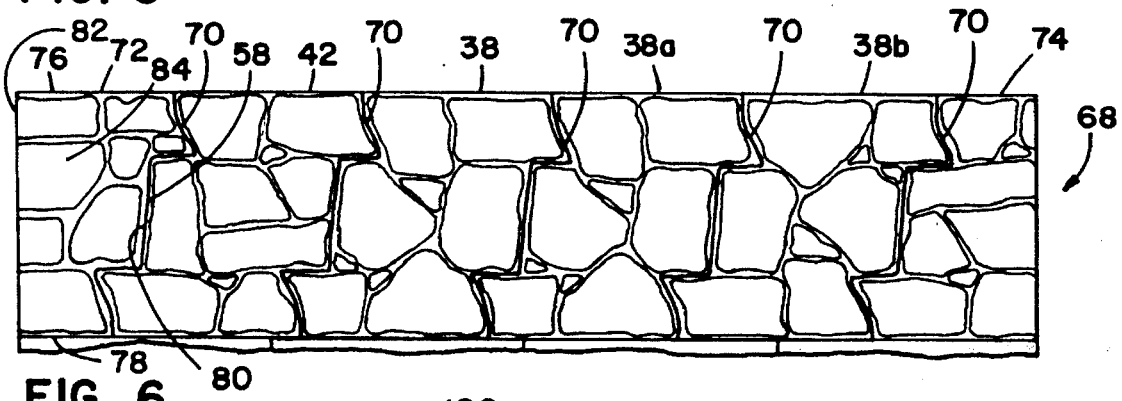
FIG. 5 is a front view of a gang form mold member including a plurality of individual mating form liners of the type shown in FIGS. 3 and 4.
Figure 6:
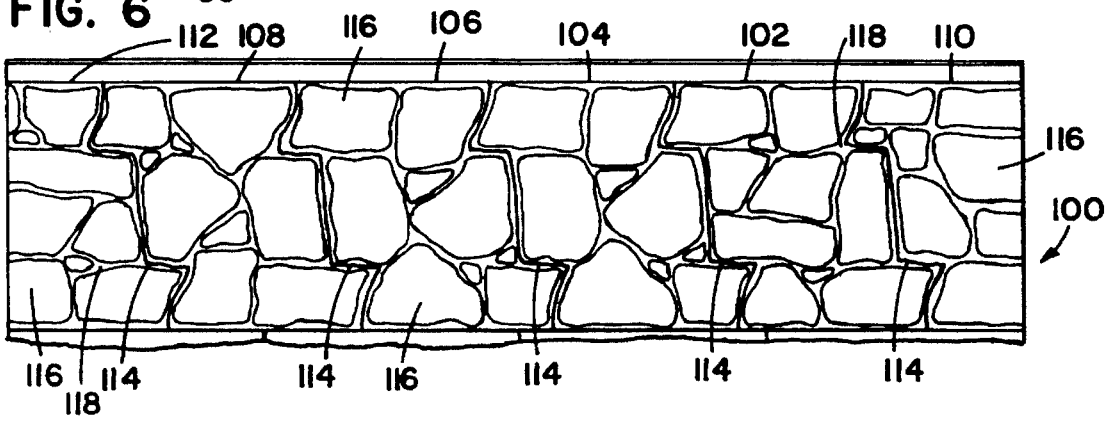
FIG. 6 is a front view of a wall formed from the gang form mold member shown in FIG. 5.
Figure 3:
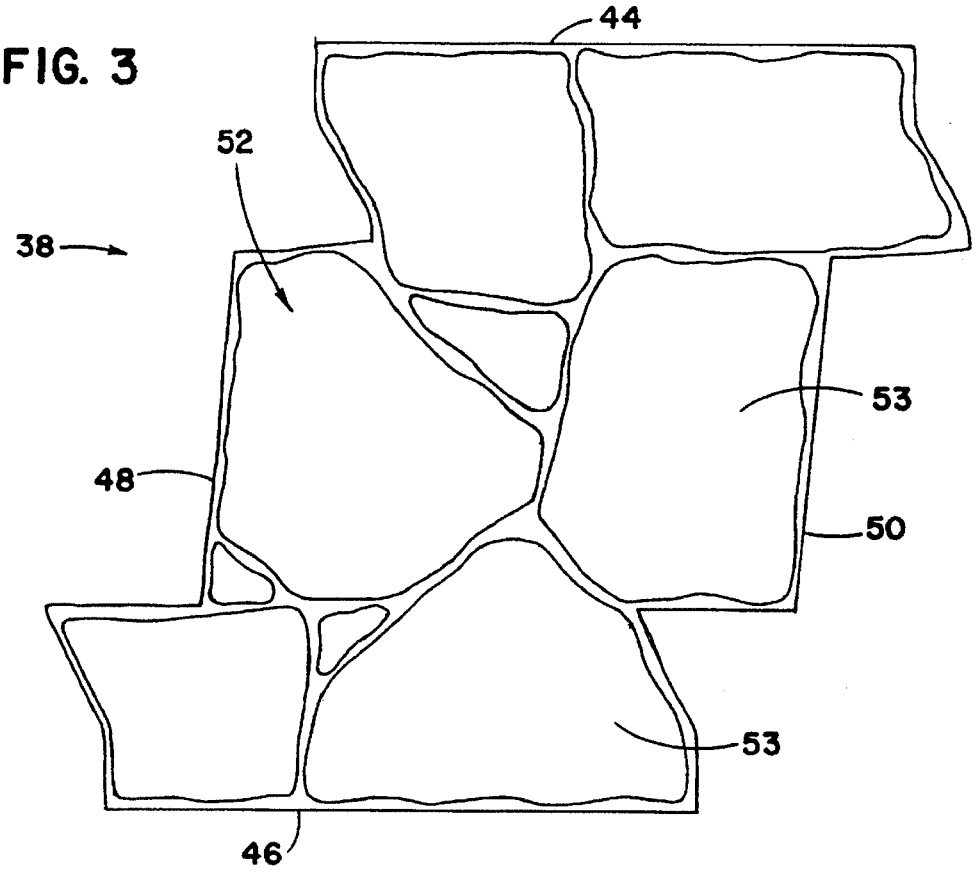
FIG. 3 is a front view of a first embodiment of a form liner.
Figure 4:
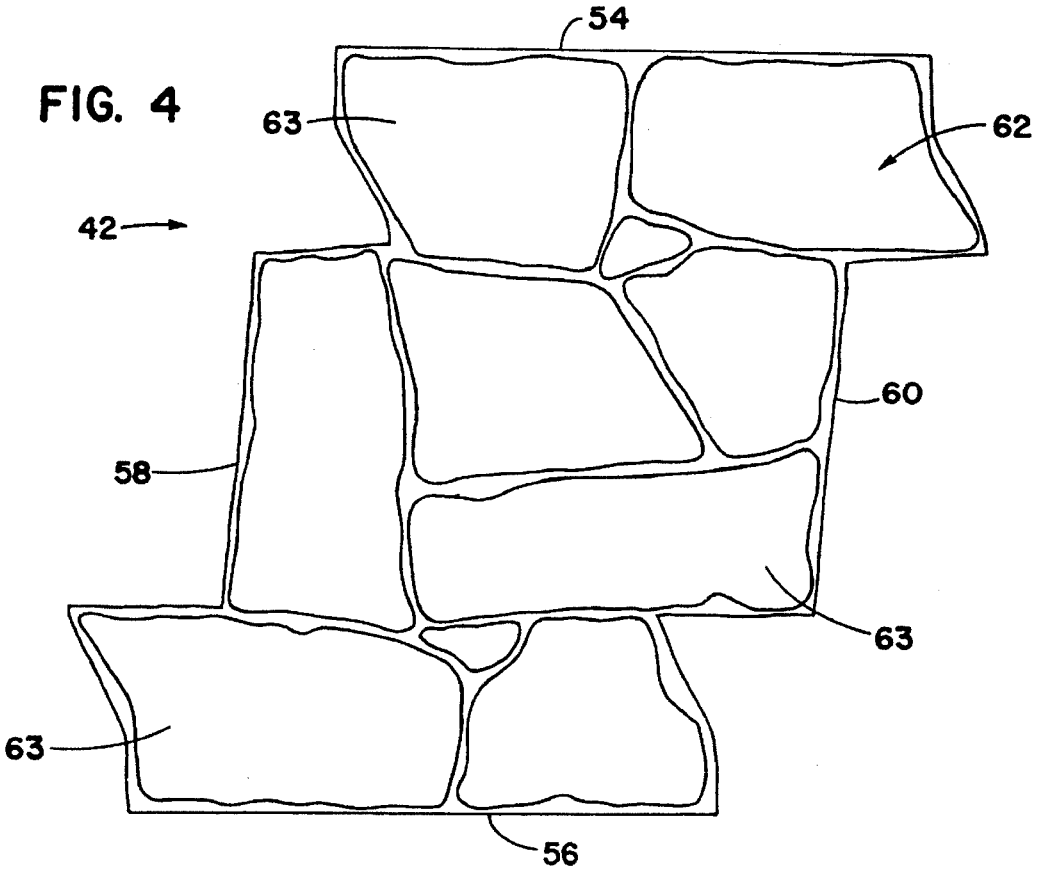
FIG. 4 is a front view of a second embodiment of a form liner.

FIGS. 3–6 illustrate in greater detail a particular application of the method shown generally in FIG. 2 to form a continuous concrete wall 100, as is illustrated in FIG. 6. The wall 100 is formed from integral wall portions of the type shown in FIG. 1 which are formed simultaneously. Referring now to FIGS. 3 and 4, two different form liners, or mold modules, of the type described generally above for use with form 34 are illustrated.

First liner 38, shown in FIG. 3, has a top edge 44 and a bottom edge 46. In the preferred embodiment, the top edge 44 and the bottom edge 46 are parallel to one another. A first non-linear mating edge 48 and a second non-linear mating edge 50 extend from the top edge 44 to the bottom edge 46 on opposite sides of the first liner 38. A lateral relief mold face 52 is surrounded by the top edge 44, bottom edge 46, first non-linear mating edge 48, and second non-linear mating edge 50. The lateral relief mold face 52 comprises a plurality of interlocking contoured relief portions 53 that are adapted to provide a surface on a concrete wall having the contour of a stone wall. Both the pattern and the texture of the lateral relief mold face 52 may be varied to form a concrete wall that resembles a wide variety of different sized and/or textured construction units.

FIG. 4 illustrates a second embodiment of a liner 42 similar to form liner 38. Form liner 42 has a top edge 54 and a bottom edge 56. In the preferred embodiment, the top edge 54 and the bottom edge 56 are parallel to one another, but may also include a non-linear mating edge, such as edges 58, 60. A first non-linear mating edge 58 and a second non-linear mating edge 60 extend from the top edge 54 to the bottom edge 56 on opposite sides of the form liner 42. The edges 58, 60 include a plurality of mating segments that define part of the perimeter of various relief portions 63. In this manner, the edges 58, 60 do not intersect or partition the relief portions (adapted to form individual stones), but instead join at various angles as part of the perimeter of the relief portion. Liner 42 has a lateral relief mold face 62 comprising a plurality of interlocking contoured relief portions 63 that are adapted to provide a surface on a concrete wall having the appearance of a stone wall. The lateral relief mold face 62 shown in FIG. 4 has a different pattern from the form liner 38 shown in FIG. 3. The form liner 42 may also be provided with a wide variety of different textures depending on the type of wall desired. It is to be appreciated that each of the stone-like portions of each form liner could have a variety of different shapes and textures and, further, the arrangement of the stone-like portions could have a variety of different patterns other than the patterns and textures shown.

The form liners shown in FIGS. 3 and 4 are shaped such that the non-linear mating edges interlock with adjacent form liners. For example, the second non-linear mating edge 50 of first liner 38 is adapted to be interlocked with the first non-linear mating edge 58 of the second liner 42 such that when the mating edges are placed in abutting relationship, a continuous lateral relief mold face is provided. Further, the second non-linear mating edge 60 of second liner 42 is adapted to be interlocked with the first non-linear mating edge 48 of the first liner 38 such that when the mating edges are placed in abutting relationship in that manner, a continuous lateral relief mold face is provided. The first form liner 38 and the second form liner 42 are also adapted to be interlocked when one of the form liners is rotated, or inverted 180 degrees in this case, relative to the other about an axis generally perpendicular to the lateral relief mold faces 52, 62. By interlocking a plurality of form liners with different patterns, a concrete wall may be formed wherein a non-repeating pattern to the contours of the interlocking relief portions is not present or is not easily visible.

Referring now to FIG. 5, a gang form mold member, or gang form 68 is shown. The gang form 68 is similarly constructed to the first mold member 10 shown in FIG. 2. The gang form 68 is comprised of a plurality of individual form liners arranged in interlocking relationships. The gang form 68 is used for forming a concrete wall comprised of a plurality of wall portions 14 integrally formed during the same pouring operation. As noted previously, each wall portion 14 could be formed with a single form liner wherein each wall portion would be formed successively. The method illustrated in FIG. 5, and noted generally by FIG. 2, permits a larger section of wall to be formed in a single pouring operation, thereby providing time and cost savings.

The gang form 68, shown in FIG. 5, is comprised of four form liners 42, 38, **38*a*, 38*b* and two terminal mold modules 72, 74. Form liner 38*a* is identical to form liner 38 and has the same orientation. Form liner 38*b* is identical to form liners 38, 38*a*, but is inverted relative to those two liners. Form liner 42 has a different pattern to form liners 38, 38*a*, 38*b*. The terminal mold modules 72, 74 provide gang form 68 with squared ends. The first terminal mold module 72 has a top edge 76 and a bottom edge 78 which are generally parallel to one another. A terminal edge 82 is generally perpendicular to the top edge 76 and the bottom edge 78. A non-linear mating edge 80 is provided to mate with the first non-linear mating edge 58 of the form liner 42. The second terminal mold module 74 is constructed similarly to the first terminal mold module 72. The gang form 68 shown in FIG. 5** presents a continuous and generally rectangular lateral relief mold face.

FIG. 5 shows the manner in which form liners, designed in accordance with the principle of the present invention, may be interlocked with one another to form the gang form 68. In some applications, only a plurality of identical form liners may be available. In that case, the form liners may be placed in abutting relationship as is shown for example by form liner 38 adjacent to form liner 38*a*. Alternatively, form liners may be provided that permit one or more to be inverted before interlocking as is shown, for example, by inverted form liner 38*b* which has a mating edge which can be interlocked with form liner 38*a*. If a plurality of form liners are provided, some with different patterns, two different form liners may be placed next to each other as is shown for example by form liner 42, which has a different lateral relief mold face from form liner 38, 38*a*, 38*b*. It is to be appreciated that, for any gang form 68, second form liner 42 could also be inverted to provide further variations for the arrangement of the form liners on gang form 68. Should three form liners or more be available in a particular construction application, even more variation is possible. Using the principles of the present invention, a contoured wall can be formed from a plurality of form liners which are arranged in a manner to give the appearance of a more random and a more natural looking stone wall than would otherwise be possible with a single liner, having either a single orientation or a vertically symmetrical pattern.

FIG. 6 illustrates the resulting concrete wall 100 formed from the gang liner 68 of FIG. 5. The wall 100 has integrally formed wall portions comprising: wall portion 102 formed from liner 42; wall portion 104 formed from form liner 38; wall portion 106 formed from form liner 38*a*; wall portion 108 formed from form liner 38*b*; and first and second terminal wall portions 110, 112 formed from first terminal mold module 72 and second terminal mold module 74.

In FIG. 5, joints 70 between adjacent form liners are indicated. As noted above, the joints 70 may lead to the formation of seam lines on the wall 100. FIG. 6 illustrates the seam lines 114 that may result. However, in some cases there may be no seam line or a negligible seam line if there is careful placement of the form liners and/or tight engagement of their mating edges. The resulting wall 100 shown in FIG. 6 more naturally resembles a stone wall because any seam lines formed from the joints 70 of the form liners are located in mortar-like portions 114 of the wall 100. As shown in FIG. 6, seam lines 114 from joints 70 do not pass through any of the stone-like portions 116 of the wall 100.

The concrete wall 100 shown in FIG. 6 is a single layer high. It is to be appreciated that a concrete wall may be formed with multiple layers of the type depicted in FIG. 6 that are placed or formed in a vertically stacked relationship. Further, it should be noted that the concrete wall 100 is generally planar but could be configured with various curves or angles. It is even possible to form right angled corners with appropriately structured form liners. Those skilled in the concrete construction art may recognize that, in some applications, concrete reinforcing materials such as steel rods located in an interior of the wall may be necessary depending upon such considerations as the height of the wall, and the environment in which the wall is to exist. Further, in some applications, the wall may be subject to expansion problems and cracking problems. These considerations may require certain modifications to the wall 100 such as periodically inserting spacers between segments of the wall during the construction process.

The form liners 36 of FIG. 2 and form liners 38, 42 illustrated in FIGS. 3 and 4 can be made from a variety of materials including plastics such as vinyl, silicone, polyurethane, and latex. Further, while FIGS. 3 and 4 illustrate only two embodiments of possible contours for the lateral relief mold faces 52, 62, it is to be appreciated that a wide variety of contours could be provided to vary the pattern and/or texture of the lateral relief mold faces. In addition, a wide variety of non-linear mating edges may be utilized. The contoured relief portions of each of the form liners illustrated project from the form liner at varying distances (see FIG. 2, reference a). Typically, the profiles may vary between approximately 2.5 centimeters and 25 centimeters. Preferably, the profiles vary at a distance of at least approximately 2.5 centimeters. More preferably, the profiles vary at least about 5 centimeters.

One method of manufacturing a form liner 36, 38, 42 of the type adapted to be mounted to a form 34 includes providing a master mold which has a master relief surface contour that is the contour of the desired concrete wall portion to be molded from the form liner. It has been found that a master relief surface contour consisting of an actual stone wall often provides a natural looking concrete surface. One technique of forming the form liner 36, 38, 42 with the reciprocal surface of the master relief surface pattern is to first create a mold cavity adjacent the master relief surface contour. Next, hardenable molding material is placed into the mold cavity and permitted to set. It has been found that laminating with polyurethane elastomers and foam works well in some cases to manufacture a form liner from an actual stone wall. The master mold and form liner are separated leaving a form liner having a reciprocal surface to the master relief surface pattern for attachment to the form 34.

Figure 7:
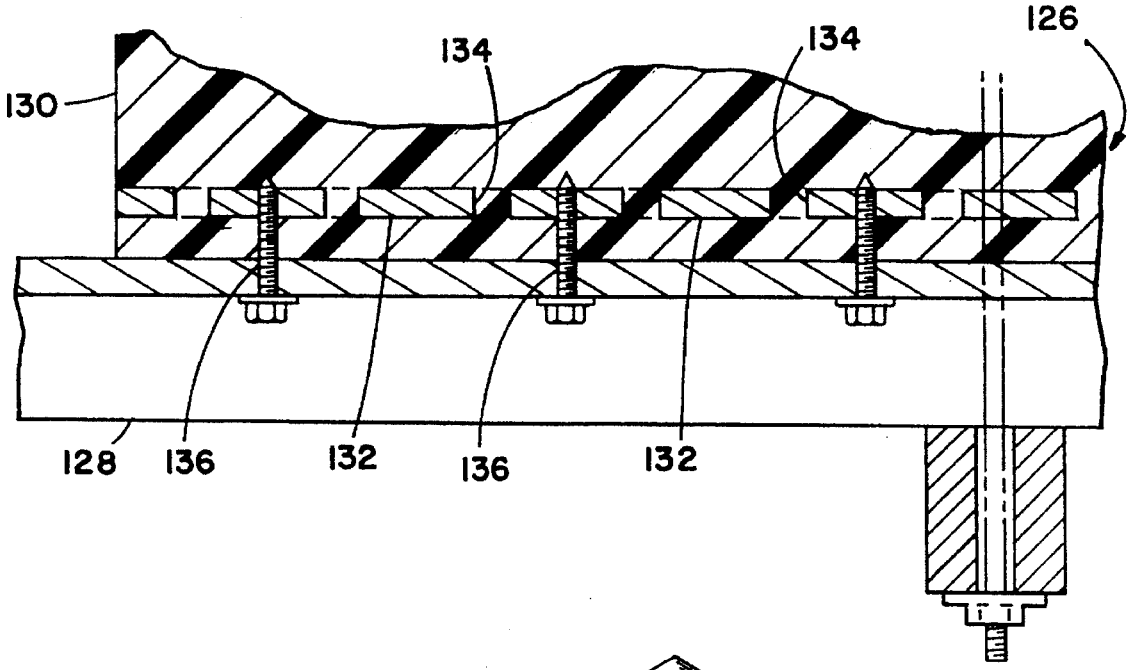
FIG. 7 is a top view in cross-section of alternative embodiment of a form liner and form of the type shown in FIG. 2.

FIG. 7 illustrates an alternative embodiment of a first mold member 126 comprising a form 128 and a form liner 130. The form liner 130 of the alternative embodiment is provided with an internal planar support member 132 adapted to attach the form liner 130 to the form 128. Preferably, the planar support member 132 is made from a material such as wood, for example plywood, for receiving screws 136. The planar support member 132 permits quick and easy attachment of form liner 130 to the form 128. One technique of manufacturing a concrete form liner 130 is to place the planar support member 132 into the hardenable molding material before the molding material has set. Holes 134 can be provide in the planar support member 132 to assist in surrounding the planar support member 132 with hardenable molding material.

Improvements have been made with respect to the systems and methods described above for creating walls having natural stone wall contours. In the embodiments shown in FIGS. 1 through 7, the form liners each create a plurality of stone regions with respect to each form liner. The embodiments shown in FIGS. 8 through 16 relate to systems and methods where each form liner contours at least a single stone region in the resulting wall.

Figure 8:
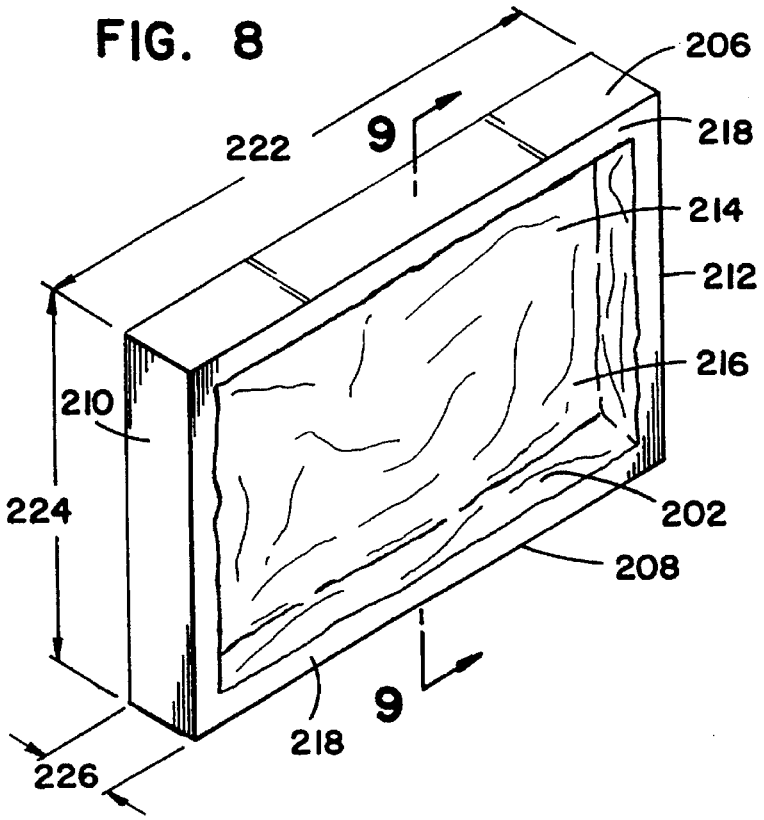
FIG. 8 is a perspective view of an embodiment of a single stone form liner.
Figure 9:
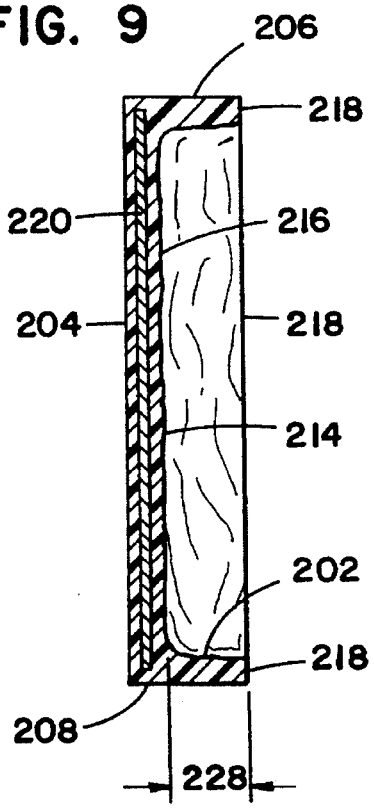
FIG. 9 is a cross sectional view of the single stone form liner shown in FIG. 8 along lines 9—9.

Referring now to FIGS. 8 and 9, a single stone form liner 200 is shown. Form liner 200 includes a front surface 202, a back surface 204, top and bottom surfaces 206,208 and first and second side surfaces 210,212. The top/bottom/side orientation of surfaces 206,208,210,212 may change depending on the orientation of liner 200 during use. Surfaces 206,208,210,212 are adapted to mate with one or more surfaces of adjacent liners positioned in abutting relationship.

Front surface 202 of liner 200 is a lateral relief mold face 214 for contouring hardenable construction material. Lateral relief mold face 214 includes a stone forming region 216. In the embodiment shown in FIGS. 8 and 9, lateral relief mold face 214 includes a mortar forming region 218 completely surrounding stone forming region 216, and further defining an edge of form liner 200.

It is to be appreciated that mortar forming region 218 may be configured to cooperate with stone forming region 216 such that a dry stack pattern is created. In a dry stack pattern, the resulting wall is contoured to resemble a wall formed from stones stacked together without visible mortar. Mortar forming region 218 would be configured to define the spaces between the resulting stone regions created by each of the form liners. By narrowing the thickness of mortar forming region 218, and possibly creating greater relief for the depth of the stone projecting from mortar region 218, a natural looking dry-stack pattern is achievable.

Liner 200 includes a support member 220 in an interior of liner 200, like support member 132 shown in FIG. 7. Support member 220 facilitates receipt of a plurality of screws to secure liner 200 to a form. Alternatively, bolts may be used in the mortar forming regions to bolt liner 200 to the form. Once the wall is formed and the form liner removed, patching or other preparation of the mortar forming region may be necessary to hide the area where the bolts were placed. Liner 200 may be made from a variety of materials like form liners 36,38,42 described above, such as polyurethane, and they can be molded directly from actual stones.

Single stone form liners like form liner 200 are useful in creating a variety of walls formed from hardenable construction material, such as concrete, where a naturally appearing stone wall results. Liner 200 includes a length dimension 222, a width dimension 224, and a thickness dimension 226. Liner 200 forms a stone region with a depth or relief dimension 228. Walls utilizing larger stone regions formed by liner 200 having a length dimension 222 and/or a width dimension 224 greater than about 12 inches may be poured utilizing the single stone form liners, although stone regions formed by liners 200 smaller than 12 inches in length and width may also be formed utilizing the single stone form liners. A wide variety of relief dimensions 228 may be provided.

Considerations impacting whether the multiple stone liner systems shown in FIGS. 1–7 are better used instead of the single stone liner 200 of FIGS. 8 and 9 include the size of the project, i.e., the number of stone regions, and whether a substantially, or a completely non-repeating pattern to the stone regions is desired. If multiple stone liners like form liners 36,38,42 are reused in a single wall, the arrangement of the stone regions created by each liner in the system of FIGS. 1–7 is not changeable, whereas the arrangement of the single stone liners of FIGS. 8 and 9 would be. Also, if a particular repeating pattern is desired, the pattern can be assembled from the single stone liners instead of manufacturing a custom multiple stone liner with the particular desired pattern. In most cases, the wall can be formed with either the multiple stone liner systems of FIGS. 1–7 or the single stone liners of the type shown in FIGS. 8–9.

Figure 10:
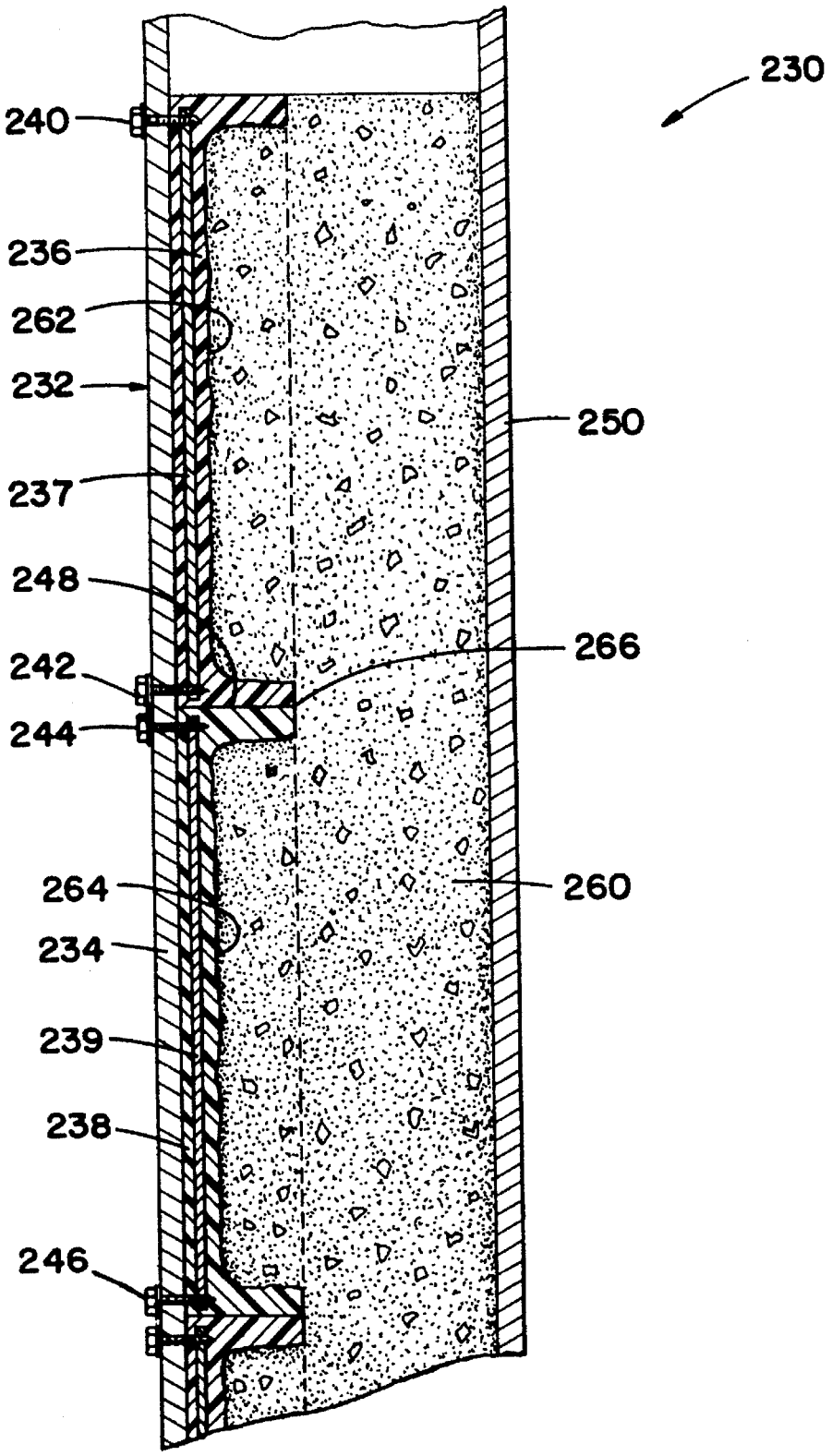
FIG. 10 is a cross sectional view of a wall forming arrangement including a plurality of single stone form liners.

Referring now to FIG. 10, a wall forming arrangement 230 is shown wherein two form liners 236,238 are used to simultaneously form the respective stone regions in a wall 260. Form liners 236,238 are similar in general construction to form liner 200 shown in FIGS. 8 and 9. In FIG. 10, a first gang form mold member 232 is provided. A backing member 234, such as a sheet of plywood or metal, is secured to first and second form liners 236,238 to produce first gang form mold member 232.

Form liners 236,238 are secured to backing member 234 in abutting relationship at region 248. Screws 240,242,244, 246 are useful for securing first form liner 236 and second form liner 238 to backing member 234. Screws 240,242 are useable to secure first form liner 236 to backing member 234 by engagement of screws 240,242 and support member 237 in an interior of first form liner 236. Likewise, screws 244,246 are useable to secure second form liner 238 to backing member 234 by engagement of screws 244,246 and support member 239. Support members 237,239 may be made from plywood or other sheet material.

Prior to pouring wall 260, a molding cavity is created adjacent first and second form liners 236,238. If the wall is to be poured vertically, then a second form 250, such as a sheet of plywood or metal, is provided. Between second form 250 and first form 232, the hardenable construction material, such as concrete, is poured into the molding cavity. First form liner 236 contours the hardenable construction material to include a first stone region 262. Second form liner 238 contours the hardenable construction material to include a second stone region 264. Once the hardenable construction material sufficiently sets, first form 232 and second form 250 can be removed leaving wall 260.

In the embodiment shown in FIG. 10, first form liner 236 and second form liner 238 cooperate to contour the hardenable construction material to include a mortar region 266. As noted above, mortar region 266 can be configured and arranged to resemble visible outlines of the stone regions 262,264 in a dry stack pattern.

Figure 11:
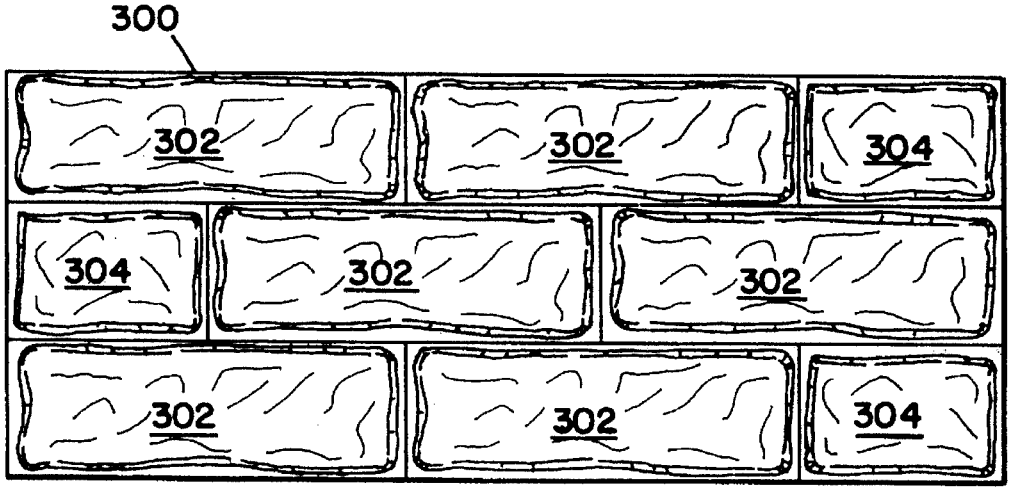
FIG. 11 is a front view of a first embodiment of a gang form mold member utilizing single stone form liners.

Referring now to FIGS. 11 through 16, various embodiments of gang form mold members are shown. In FIG. 11, gang form mold member 300 is shown comprising a plurality of first form liners 302 and second form liners 304. Form liners 302,304 are similar in general construction to form liner 200 shown in FIGS. 8 and 9. Form liners 302,304 are mounted to a backing member (not shown), like backing member 234, of FIG. 10 to form the gang form mold member 300. When form liners 302,304 are arranged and secured in the gang form mold member 300 of FIG. 11, a continuous lateral relief mold face results.

In gang form mold member 300, form liners 302,304 can be arranged in a plurality of different arrangements other than the arrangements shown. Different orientations relative to the vertical are also possible, i.e., rotating the form liners in multiples of 90° about an axis transverse to the major planar shape defined by each form liner. Gang form mold member 300 has a rectangular outer perimeter. Other arrangements of form liners 302,304 are possible wherein gang form mold member 300 maintains its rectangular outer perimeter. Rectangular outer perimeters are advantageous for construction processes where sections of wall are poured simultaneously or successively by butting up the linear edges of adjacent gang form mold members and/or wall sections. Due to the ability to easily rearrange the form liners, adjacent sections of wall will not have easily identifiable patterns to the stone regions, if desired.

Gang form mold member 300 creates a straight running bond pattern. First form liner 302 is four units wide and 12 units long. Second form liner 304 is four units wide and 6 units long. In gang form mold member 300, the horizontal edges and the vertical edges are each formed by a plurality of form liners 302,304.

Figure 12:
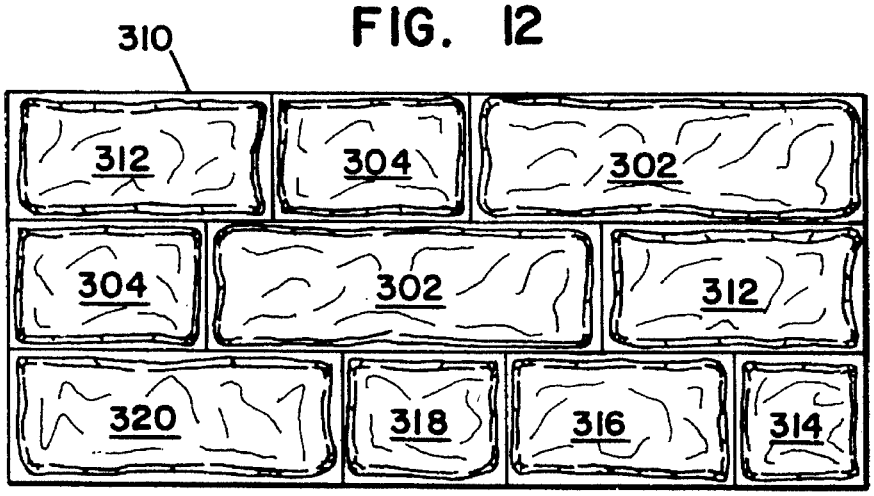
FIG. 12 is a front view of a second embodiment of a gang form mold member utilizing single stone form liners.

Referring now to FIG. 12, a second gang form mold member 310 is shown. Gang form mold member 310 includes a plurality of different form liners. Form liners 302,304 are present in gang form mold member 310. Also, gang form mold member 310 includes different sized form liners 312,314,316,318,320. Form liner 312 is four units wide by eight units long. Form liner 314 is four units wide by four units long. Form liner 316 is four units wide by seven units long. Form liner 318 is four units wide by five units long. Form liner 320 is four units wide by ten units long. Form liners 302,304,312,314,316,318,320 are arrangeable in a plurality of different patterns and orientations to create a random running bond pattern.

Figure 13:
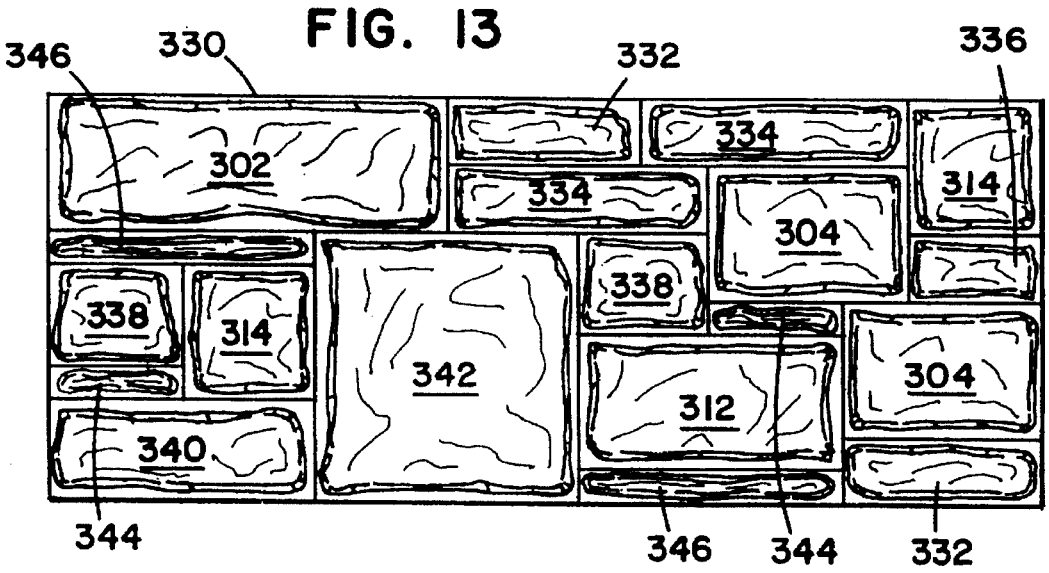
FIG. 13 is a front view of a third embodiment of a gang form mold member utilizing single stone form liners.

Referring now to FIG. 13, a third gang form mold member 330 is shown. Gang form mold member 330 includes form liners 302,304,312,314 as used in one or both of gang form members 300,310. Also, gang form mold member 330 includes additional liners 332 (two units by six units), 334 (two units by eight units), 336 (two units by four units), 338 (three units by four units), 340 (three units by eight units), 342 (eight units by eight units), 344 (one unit by four units), 346 (one unit by eight units). Gang form mold member 330 includes configurations to the form liners which are different in a length dimension relative to form liner 302 of FIG. 11 and/or different in width dimension relative to form liner 302 of FIG. 11. Various arrangements to the pattern of the stones in gang form mold member 330 are possible to achieve a random pattern to the resulting wall if multiple sections of wall are poured using gang form mold member 330. Gang form mold member 330 is useful for creating a random ashlar pattern.

Figure 14:
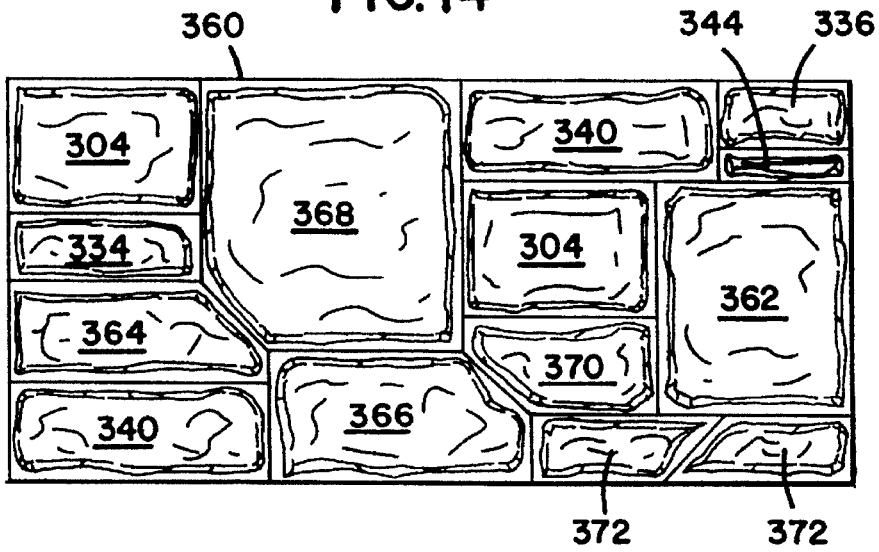
FIG. 14 is a front view of a fourth embodiment of a gang form mold member utilizing single stone form liners.
Figure 15:
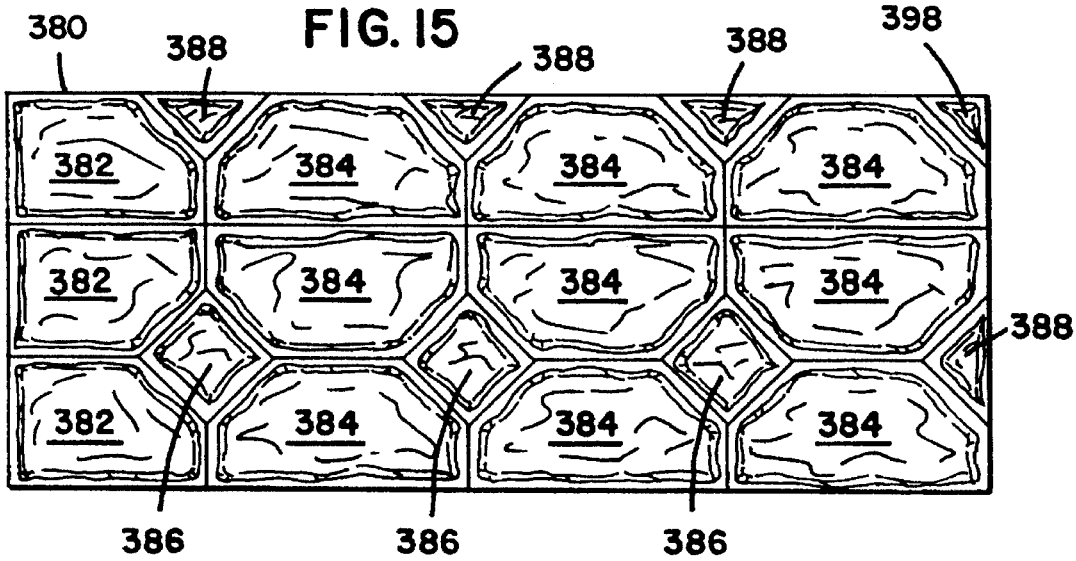
FIG. 15 is a front view of a fifth embodiment of a gang form mold member utilizing single stone form liners.
Figure 16:
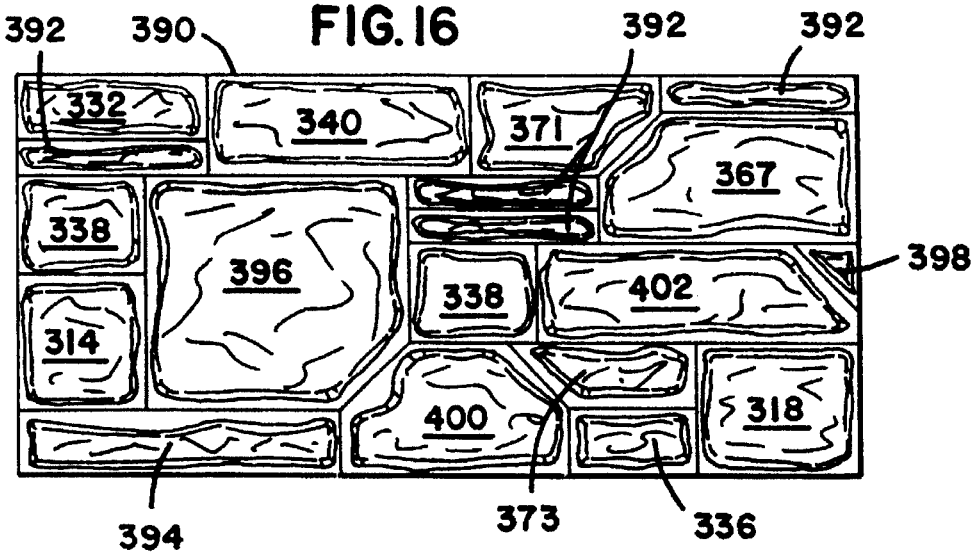
FIG. 16 is a front view of a sixth embodiment of a gang form mold member utilizing single stone form liners.

Referring now to FIGS. 14 through 16, fourth gang form mold member 360, fifth gang form mold member 380, and sixth gang form mold member 390 are shown. Additional variations in length and width are provided for the form liners, such as form liner 362 (six units by eight units), form liner 392 (one unit by six units), and form liner 394 (two units by ten units).

Also shown in FIGS. 14 through 16 are variations with respect to the form liners with respect to nonrectangular outer perimeters of the form liners. Such variations permit additional versatility in creating different stone patterns on the resulting wall. In FIGS. 14 and 16, gang form mold members 360 and 390 are useful in creating random patterns. Alternatively, gang form mold member 380 of FIG. 15 is useful in creating a repeating pattern utilizing nonrectangular stone regions. Nonrectangular perimeters to the form liners are provided with respect to form liners 364,366,367, 368,370,371,372, 373,382,383,384,388,400,402. All of the nonrectangular edges are created by 45 degree angles relative to the vertical (cut across two units by two units) with respect to these form liners.

It is to be appreciated that other angles may be employed other than 45 degrees as long as reciprocal mating surfaces are provided between form liners. Other angles are possible, such as 30 and 60 degree angles. In FIG. 15, form liners 386, which have a square shape, are utilized to fill voids between liners 384. It is noted in FIGS. 15 and 16 that form liners 384,400 have two 45 degree angled edges.

Another embodiment of the invention includes an alternative gang form mold member (not shown) including a plurality of single stone form liners that mate with adjacent form liners along non-linear mating edges. The form liners of FIGS. 11–16 all mate along linear edges.

The alternative gang form mold member includes a plurality of first form liners. The first form liners each include a circular outer perimeter. In the alternative gang form mold member, the upper most row of form liners is created with three identical first form liners. However, the first form liners in the uppermost row have all been rotated relative to one another 90°.

Second form liners are positioned in mating relationship with the first form liners of the uppermost row. Each second form liner includes a complimentary mating edge to mate with a mating edge of the first form liners. The mating edges of the first form liners and the second form liners are each defined by a radius. Alternatively, the first form liners may be oval-shaped. In that case, the second form liners would have a complimentary mating edge to mate with a portion of the oval-shaped perimeter of the first form liners.

The first form liners each include a stone forming region and a mortar forming region completely surrounding the stone forming region. The second form liners each include a stone forming region completely surrounded by a mortar forming region. In some walls, a dry stacked pattern is preferred. Therefore, the mortar forming regions would be structured appropriately to produce the dry stacked pattern.

Third, fourth, and fifth form liners may also be provided for use in the alternative gang form mold member. The third, the fourth, and the fifth form liners each have different stone patterns than the first form liners.

In the alternative gang form mold member, there are various regions which do not include any stone forming region in the resulting wall. These regions may be provided with an appropriate structure to create a small stone region in the resulting wall.

It is to be appreciated that the first, the second, the third, the fourth, and the fifth form liners are usable in a plurality of orientations about an axis transverse to the major plane generally defined by the alternative gang form mold member. This assists in creating a more random looking wall since the repeating stone patterns would not be easily visible if one or more form liners was rotated relative to another identical form liner.

The alternative gang form mold member includes a backing member to which each of the form liners is mounted. It is to be appreciated that the form liners of the alternative gang form mold member include curved non-linear mating edges. Non-linear mating edges comprised of linear segments may also be provided.

The present invention also relates to an alternative form comprising:

(a) a plurality of form liners, each form liner including:
  (i) a front surface including a first portion adapted to contour at least one stone region on a wall formed against said lateral relief mold face, and a second portion completely surrounding said first portion and adapted to contour a mortar region on said wall formed against said lateral relief mold face;
  (ii) a non-linear mating edge defining an edge of said front surface; and
  (iii) a back surface disposed on an opposing side of said form liner opposite to said front surface;

(b) a backing member; and (c) means for mounting said back surface of each of said form liners to said backing member wherein said form liners are mounted in an adjacent mating relationship along said non-linear mating edge of each form liner to create a continuous lateral relief mold face.

The single stone liners of FIGS. 8–16 are useable in combination with the multiple stone liners shown in FIGS. 1–7, such as at the end of a wall. The single stone liners may also be used in wall constructions where larger stone regions are formed in the lower vertical half of the wall. In the upper vertical half of the wall, smaller stone regions may be formed. It may be more efficient to form the smaller stone regions with multiple stone liners. The single stone liners may also be utilized in a precast technique where the stone portions are formed independently and the assembled into a wall.

It is to be understood, that even though numerous characteristics and advantages of the invention have been set forth in the foregoing description, together with details of the structure and function of the invention, the disclosure is illustrative only, and changes may be made in detail, especially in matters of size, shape, and arrangement of the parts wherein the principles of the invention to the full extent indicated by the broad general meaning of the terms in which the appended claims are expressed.

What is claimed is:

1. A form liner for molding a portion of a natural stone wall in hardenable construction material poured against the form liner, the form liner comprising:

(a) a lateral relief mold face including:

(i) a recessed central surface portion located central to the lateral relief mold face, the central surface portion having an irregular textured surface having a configuration of a reverse contour to a single natural stone for forming a natural stone region in the wall; and (ii) a raised border surface portion contiguous with and completely surrounding the central surface portion, the border surface portion having a textured surface having a configuration of a reverse contour to a mortar region of a natural stone wall for forming a mortar region contiguous with and surrounding the natural stone region in the wall;

(b) a generally planar back surface facing in an opposite direction to the lateral relief mold face, the back surface engageable with a backing member; and (c) a continuous edge surface contiguous with and surrounding the back surface, the edge surface being perpendicular to the direction faced by the back surface, the edge surface further contiguous with and surrounding the border surface portion, wherein the form liner molds only a single natural stone region completely surrounded by a mortar region in a wall poured against the form liner.

2. The form liner of claim 1, wherein the form liner of claim 1 is a first form liner and further comprising a second form liner comprising:

(a) a lateral relief mold face including:

(i) a recessed central surface portion located central to the lateral relief mold face, the central surface portion having an irregular textured surface having a configuration of a reverse contour to a single natural stone for forming a natural stone region in the wall; and (ii) a raised border surface portion contiguous with and completely surrounding the central surface portion, the border surface portion having a textured surface having a configuration of a reverse contour to a mortar region of a natural stone wall for forming a mortar region contiguous with and surrounding the natural stone region in the wall;

(b) a generally planar back surface facing in an opposite direction to the lateral relief mold face, the back surface engageable with the backing member; and (c) a continuous edge surface contiguous with and surrounding the back surface, the edge surface being perpendicular to the direction faced by the back surface, the edge surface further contiguous with and surrounding the border surface portion, wherein the second form liner molds only a single natural stone region completely surrounded by a mortar region in a wall poured against the second form liner, the edge surface of the second form liner engaged with the edge surface of the first form liner.

3. The form liner of claim 2, wherein the edge surface of each of the first and second form liners defines a different outer perimeter.

* * * * *